US005416468A

United States Patent [19]

Baumann

[11] Patent Number: 5,416,468

[45] Date of Patent: May 16, 1995

[54] TWO-TIERED SYSTEM AND METHOD FOR REMOTE MONITORING

[75] Inventor: William J. Baumann, Tempe, Ariz.

[73] Assignee: Motorola, Inc., Schaumburg, Ill.

[21] Appl. No.: 143,031

[22] Filed: Oct. 29, 1993

[51] Int. Cl.[6] ..... G08B 21/00

[52] U.S. Cl. ..... 340/573; 340/539

[58] Field of Search ..... 340/573, 539

[56] References Cited

U.S. PATENT DOCUMENTS

| | | | |
|---|---|---|---|
| 4,549,169 | 10/1985 | Moura et al. | 340/573 |
| 4,743,892 | 5/1988 | Zayle | 340/573 |
| 4,858,622 | 8/1989 | Osterweil | 128/782 |
| 4,999,613 | 3/1991 | Williamson et al. | 340/573 |
| 5,115,223 | 5/1992 | Moody | 340/573 |
| 5,157,604 | 10/1992 | Axford et al. | 364/413.03 |
| 5,170,426 | 12/1992 | D'Alessio et al. | 379/38 |
| 5,223,816 | 6/1993 | Levinson et al. | 340/539 |

*Primary Examiner*—Glen Swann

*Attorney, Agent, or Firm*—Frederick M. Fliegel

[57] ABSTRACT

A communication and processing system (10) monitors signals transmitted from personal transmitter units (PTUs 20) to determine whether alarm or emergency conditions have occurred and whether scheduled communications from PTUs (20) are missing. The PTUs (20) detect various alarm and emergency conditions and transmit data communications to a field node (18). The field node (18) receives data communications from all PTUs (20) within range. If a data communication indicates an emergency condition, a field report message is immediately sent to a control facility (12). If a communication indicates an alarm condition, an audible alarm is sounded at the field node but no message is sent to the control facility yet. If the alarm condition is not corrected within a predetermined period of time, a message describing the alarm condition is sent to the control facility (12). When scheduled communications from a PTU (20) are not received at the field node (18), the situation is treated as an alarm condition.

26 Claims, 8 Drawing Sheets

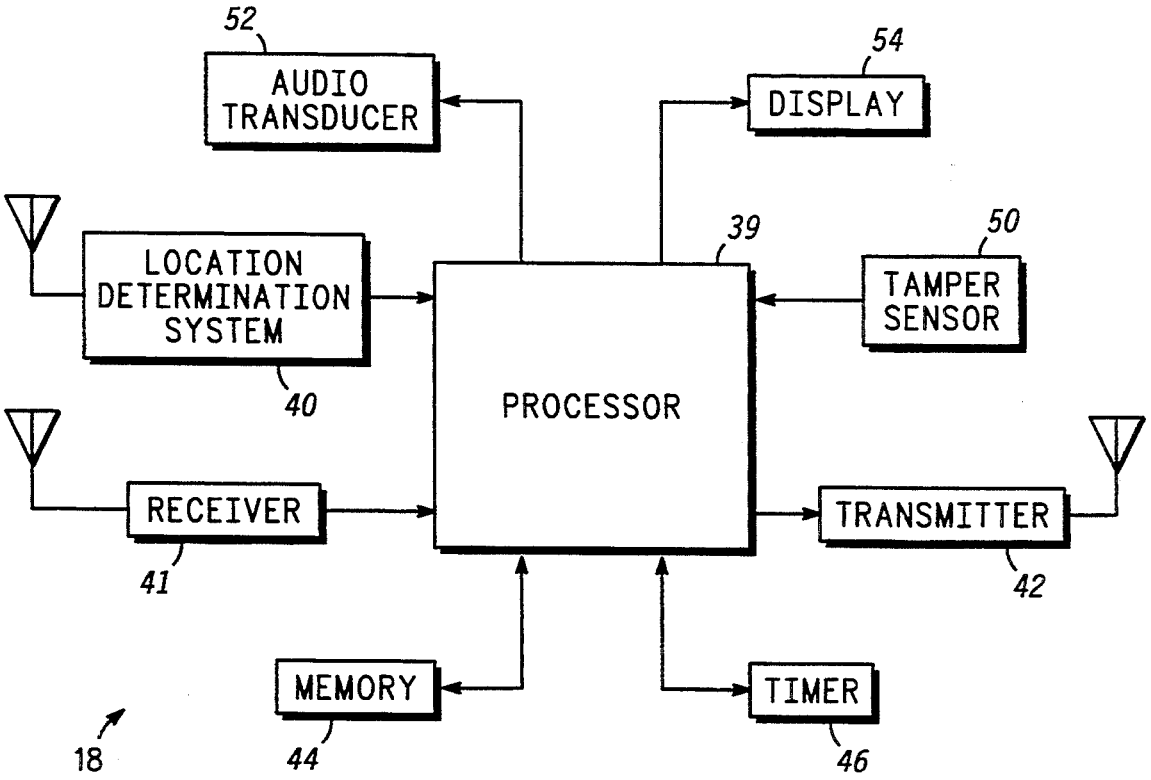
FIG. 2
FIG. 3
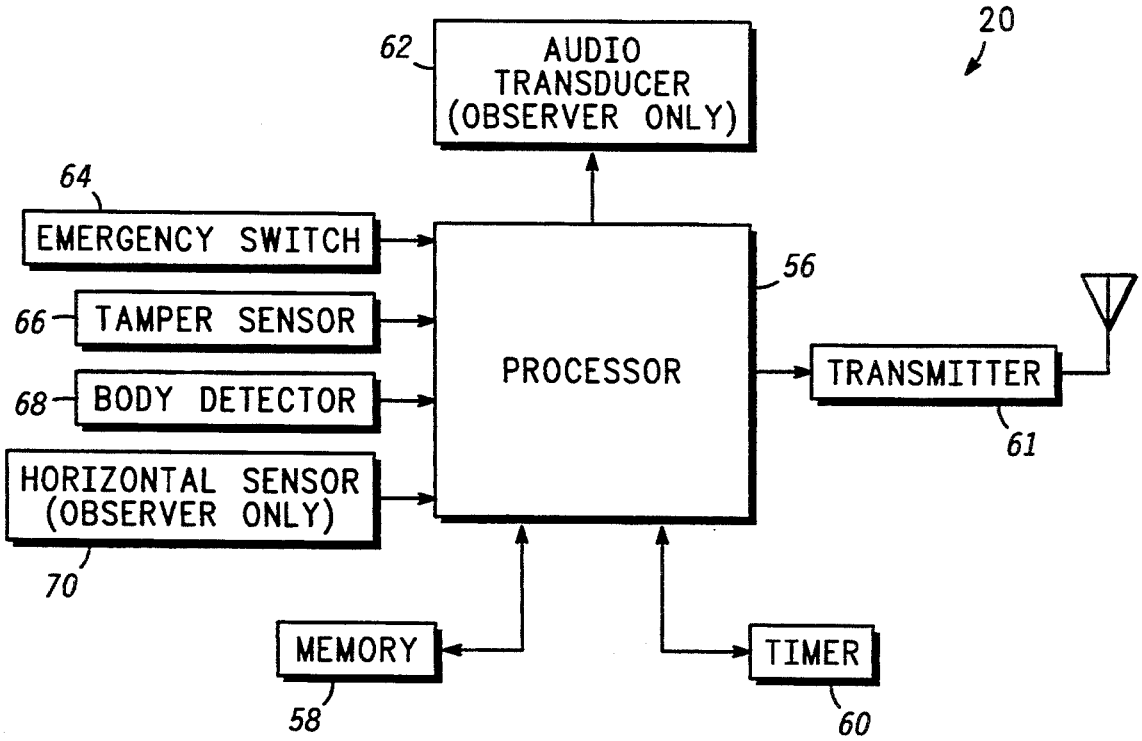

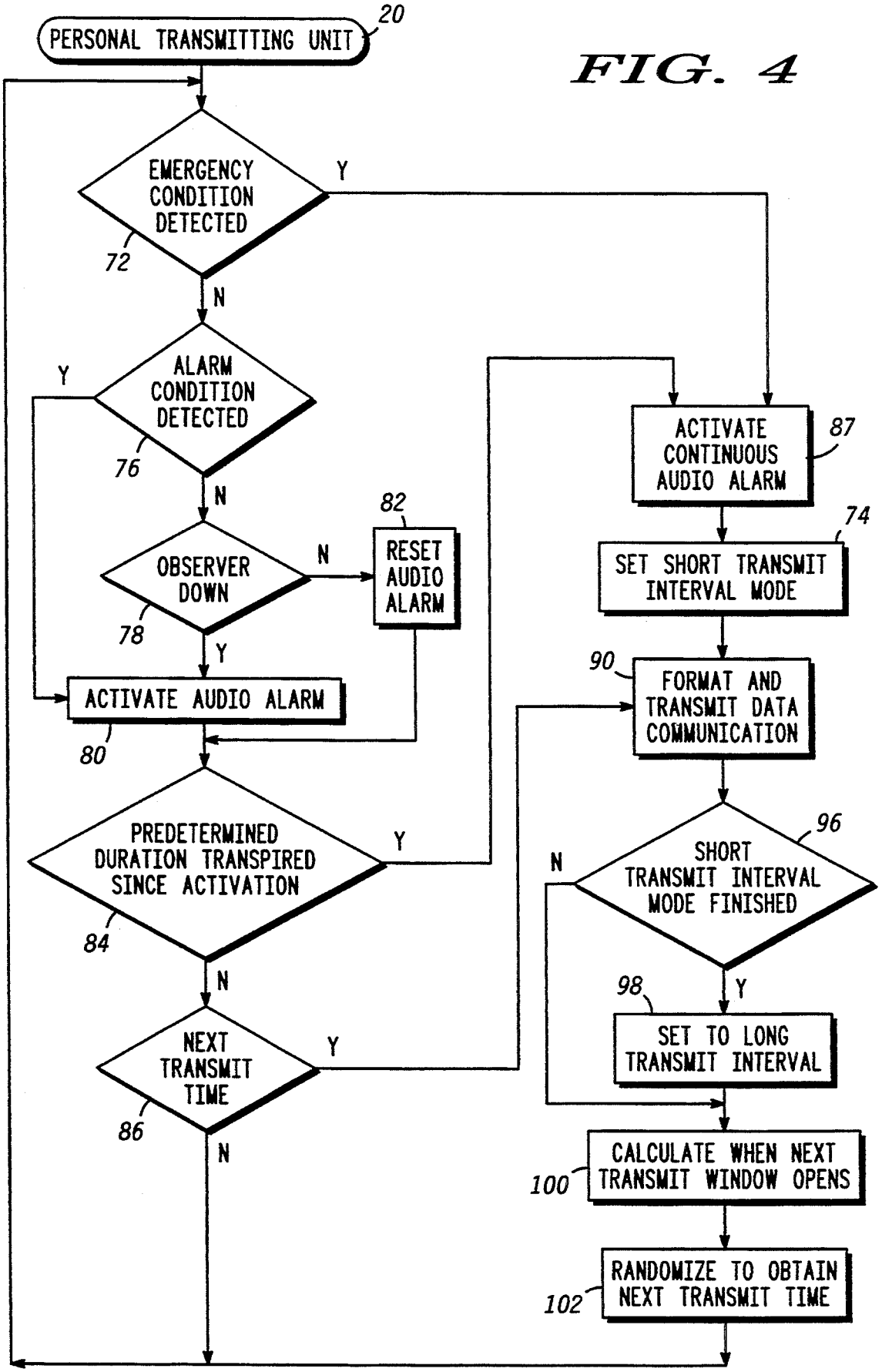
PERSONAL TRANSMITTING UNIT
20
FIG. 4
EMERGENCY CONDITION DETECTED
72
Y
N
ALARM CONDITION DETECTED
76
Y
N
OBSERVER DOWN
78
N
Y
RESET AUDIO ALARM
82
ACTIVATE AUDIO ALARM
80
PREDETERMINED DURATION TRANSPIRED SINCE ACTIVATION
84
Y
N
NEXT TRANSMIT TIME
86
Y
N
ACTIVATE CONTINUOUS AUDIO ALARM
87
SET SHORT TRANSMIT INTERVAL MODE
74
FORMAT AND TRANSMIT DATA COMMUNICATION
90
SHORT TRANSMIT INTERVAL MODE FINISHED
96
N
Y
SET TO LONG TRANSMIT INTERVAL
98
CALCULATE WHEN NEXT TRANSMIT WINDOW OPENS
100
RANDOMIZE TO OBTAIN NEXT TRANSMIT TIME
102

| PERSONAL TRANSMITTING UNIT VARIABLES | |
|---|---|
| PTU ID | 92 |
| SENSORS STATUS | 94 |
| TRANSMIT WINDOW OPEN TIME | 106 |
| NEXT TRANSMIT TIME | 88 |
| SHORT/LONG REPEAT INTERVAL MODE | 75 |
| EMERGENCY ACTIVATION TIMER | 73 |
| OBSERVER DOWN TIMER | 81 |
| ⋮ | |

TWO-TIERED SYSTEM AND METHOD FOR REMOTE MONITORING

TECHNICAL FIELD OF THE INVENTION

The present invention relates generally to systems and methods for monitoring objects and particularly for monitoring people. More specifically, the present invention relates to systems and methods for monitoring a plurality of monitorees in a field setting.

BACKGROUND OF THE INVENTION

In field settings, observers often have the job of monitoring any number of dispersed monitorees. In one situation, a prison corrections officer has the role of observer while prisoners on work crews are monitorees. In another situation, a teacher has the role of observer while children on a field trip are monitorees. In still another situation, an operations manager or coordinator may have the role of observer while any number of persons involved in search and rescue missions, fire fighting, or other hazardous operations (e.g., electrical and/or natural gas distribution system repair and/or installation operations, chemical plant workers etc.), are monitorees. In these and other situations, the observer's job is often a difficult one which requires constant attention. A single momentary lapse in diligence on the part of the observer can lead to disastrous consequences.

Typically, an observer's responsibilities include, among other things, knowing the whereabouts of monitorees even though monitorees may be dispersed over a large or obscured area. In addition, an observer's responsibilities often include the exercise of good judgment in knowing when to ask for additional help and when not to ask for additional help. The observer typically needs to quickly recognize when additional help is needed, and the observer typically needs to quickly communicate that need when the occasion arises.

Due at least in part to the difficult nature of the observer's job, field activities are often severely restricted and undesirably costly. Often a large number of observers are required for a given population of monitorees. When suitable observers are not available, field activities are curtailed. Labor costs of field activities are undesirably high when a large number of observers are required for a given number of monitorees. Likewise, when only a few observers are available, the population of monitorees is often restricted to only a few of the most trustworthy or competent monitorees.

SUMMARY OF THE INVENTION

Accordingly, it is an advantage of the present invention that an improved method and system for remote monitoring is provided.

Another advantage of the present invention is that a system and method are provided which make an observer's job easier.

Another advantage is that the present invention lessens the costs associated with monitoring a population of monitorees.

Another advantage is that the present invention improves the efficiency of an observer who monitors a population of monitorees.

Another advantage is that the present invention improves safety for an observer monitoring a population of monitorees and for the monitorees.

The above and other advantages of the present invention are carried out in one form by a method of monitoring a plurality of monitorees. The method calls for retaining, at a field node, data identifying unique codes for the monitorees. A transmitter is associated with each of the monitorees. Each of the transmitters repetitively transmits one of the unique codes from time to time in accordance with a predetermined schedule. The field node receives at least a portion of the transmitted codes. An alarm at the field node is activated when one of the unique codes has not been received in accordance with this schedule. The alarm is desirably but not essentially reported back to a central facility.

BRIEF DESCRIPTION OF THE DRAWINGS

A more complete understanding of the present invention may be derived by referring to the detailed description and claims when considered in connection with the Figures, wherein like reference characters refer to similar items throughout the Figures, and:

FIG. 2 is a block diagram of a field node used by a preferred embodiment of the present invention;

FIG. 3 is a block diagram of a personal transmitter unit used by a preferred embodiment of the present invention;

FIG. 4 is a flow chart of tasks performed by the personal transmitter unit;

Figure 1:
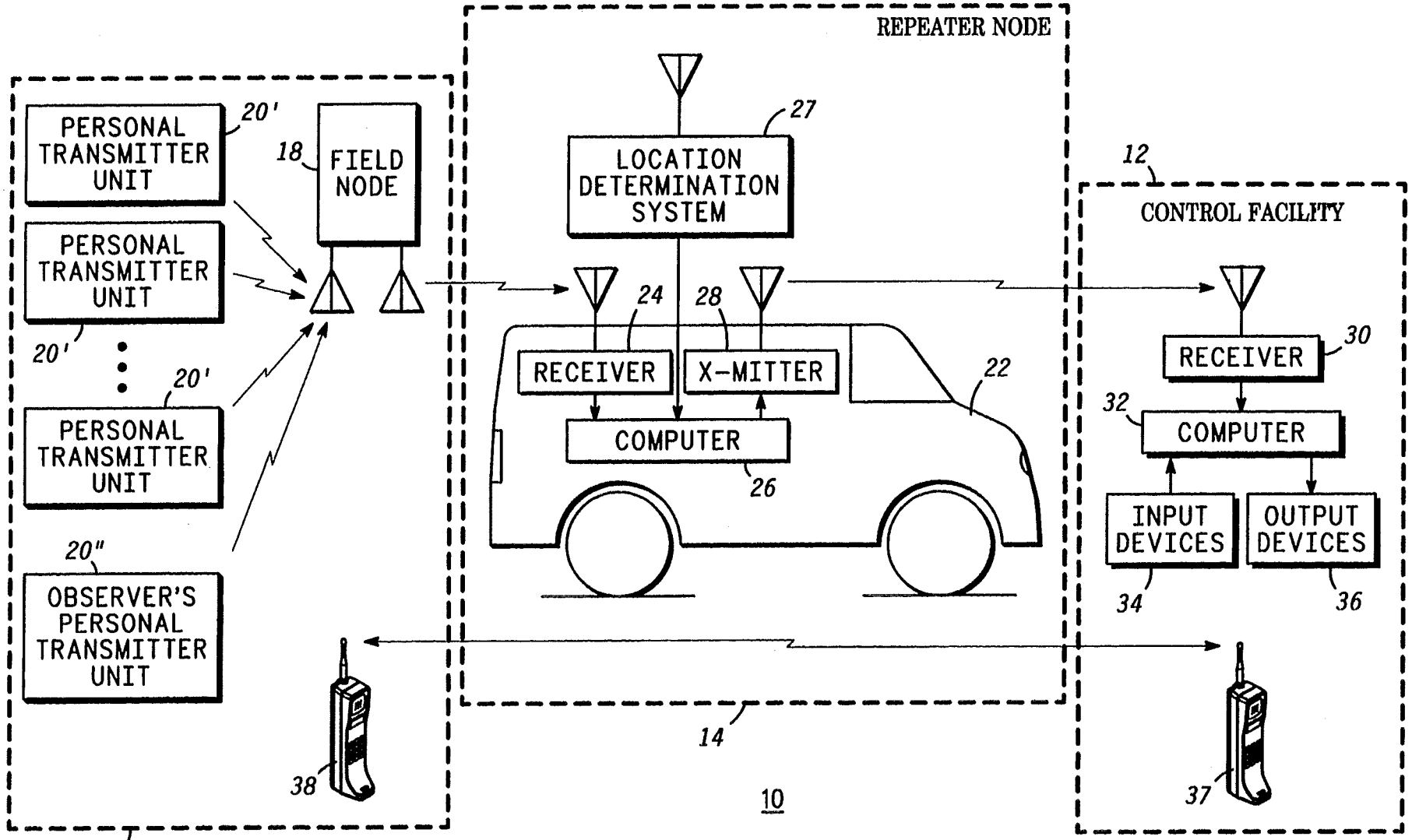
FIG. 1 is a block diagram depicting the environment within which a preferred embodiment of the present invention operates.

In the following description of preferred embodiments, certain items are similar to other items in many respects. This description distinguishes such items from their counterparts by the use of primes (', '', and so on) appended to a common reference character. When primes are omitted, the description refers to any one of such items and their counterparts individually or to all of them collectively.

DETAILED DESCRIPTION OF THE PREFERRED EMBODIMENTS

FIG. 1 is a block diagram depicting the environment within which a preferred embodiment of the present invention operates. Processing and communication system 10 operates throughout two or three distinct locations. System 10 includes control facility 12 at a first location, optional repeater node 14 at a second location, and various other devices in field area 16. These other devices may include field node 18 and any number of personal transmitter units (PTUs) 20' and 20''. PTUs 20' are transmission devices worn or otherwise associated with monitorees, or attached to objects of value (e.g., museum paintings etc.). PTUs 20'' are transmission devices like PTUs 20' except that they are worn or otherwise associated with observers. Preferably, each observer and monitoree in field area 16 has his or her own PTU 20. PTUs 20 may include capability for detecting various conditions and transmitting data describing the detected condition and accordingly PTUs 20 are alternatively known as detection units.

Generally, control facility 12 is associated with a "home" area, but may be portable or portable in some applications (e.g., search and rescue etc.). When system 10 monitors prisoners, control facility 12 may be located at a prison. When system 10 monitors children, control facility 12 may be located at a school building. Typically, control facility 12 resides at a location that monitorees and observers leave when they go into the field but may be a central office not visited by monitorees (e.g., security office in a mall, zoo, manufacturing facility etc.).

When observers and monitorees go into the field they may be viewed as residing in field area 16, regardless of any particular location for field area 16. However, field area 16 is typically remotely located from control facility 12. Monitorees may face greater dangers or have greater opportunities to cause mischief or escape observers' authority in field area 16 than in or near control facility 12. System 10 is particularly helpful in monitoring monitorees in field area 16. When the remote location is coupled to a map database, this system may be used to monitor and control coordinated search and rescue operations.

PTUs 20 each broadcast a stream of data communications. Preferably, all PTUs 20 use the same channel(s) for communications, and field node 18 receives and detects these data communications. Channel diversity (distinct groups of PTUs 20 employing distinct channel(s)) may be employed in some applications. However, PTUs 20 must be within range of field node 18 before field node 18 can receive their communications. Preferably, this range is short, desirably within 50–100 meters of field node 18 and usefully less than 0.3 km. In some applications (e.g., search and rescue, manhunt etc.), longer ranges (e.g., ca. 1–10 km) are desirable and this may be achieved by providing PTUs 20 with higher transmitter power, for example.

Field node 18 processes the received communications to make certain that communications are being received from all monitorees and that no alarm or emergency conditions are indicated. If an alarm condition is indicated or if data communications from one of the monitored PTUs 20 is missing, alarms annunciated at field node 18 inform observers of the situation. If the observer can correct the alarm or missing signal situation within a predetermined period of time, e.g., 30 seconds to a few minutes, no further action is taken. However, if an emergency situation is detected, or if an alarm or missing signal situation has been detected and not corrected for the predetermined period of time, field node 18 automatically sends a field report message to control facility 12 to inform control facility 12 of the situation. Details concerning these and other operations of PTUs 20 and field node 18 are discussed below.

Preferably, field node 18 is constructed as a battery-powered, portable, or at least back-packable, unit. The observer thus can carry field node 18 from place to place, maintaining PTUs 20 within range of field node 18. Due to the portable, battery-powered nature of field node 18, low power signals may be used to carry the field report messages automatically transmitted from field node 18 to control facility 12. In order for field node 18 to successfully communicate field report messages to a distant control facility 12, signals transmitted from field node 18 may be repeated through repeater node 14.

In a preferred embodiment, repeater node 14 may be located in vehicle 22 which transports monitorees to a point near field area 16. Repeater node 14 may include receiver 24, location determination system 27 (e.g., a global positioning system or GPS receiver), computer 26 and transmitter 28. Thus, repeater node 14 need not be as portable as field node 18. Repeater node 14 retransmits field report messages using signals exhibiting greater power so that field report messages may be successfully communicated to even a distant control facility 12. In addition, repeater node 14 may reformat field report messages into a format compatible with the requirements of control facility 12 and may add additional data thereto.

Repeater node 14 may optionally be omitted and field node 18 may, for example, communicate directly with control facility 12 through land-based or space-based cellular radiotelephone systems, or through direct radio links. In addition, while FIG. 1 illustrates communication of field report messages as being in only one direction from field node 18 to control facility 12, those skilled in the art will appreciate two-way communications optionally may be employed for particular applications.

Control facility 12 receives field report messages at receiver 30, which passes them to computer 32. Computer 32 may be a conventional personal computer and may include conventional computer components, e.g., memory devices, processors etc. In addition, various input devices 34, e.g., a keyboard, mouse, barcode reader, RS-232 port, removable disk drive etc., are usefully associated with computer 32 as well as various output devices 36, e.g., a printer, video display, audio loudspeaker, RS-232 port, removable disk drive etc.

When computer 32 receives a field report message, it processes the message to determine whether a situation requiring further attention is being reported. If so, appropriate alarms are annunciated. When an operator at control facility 12 detects such alarms, the operator may use conventional two-way radio set 37 to attempt to engage in voice communications through a corresponding two-way radio set 38 with an observer in field area 16. Depending upon the results of this attempted voice communication, the operator may decide to take further action, e.g., sending reinforcements to field area 16. Of course, those skilled in the art will appreciate that other devices, e.g., cellular radiotelephones, may be used for such two-way voice communications. Computer 32 may also provide correlation of PTU locations with a map overlay. Further details concerning operation of control facility 12 are discussed below.

FIG. 2 is a block diagram of field node 18 used by a preferred embodiment of the present invention. Field node 18 includes processor 39. Location determination system 40 is coupled to processor 39 and supplies data describing a current location for field node 18. In a preferred embodiment, location determination system 40 is a conventional Global Positioning System (GPS) receiver. Those skilled in the art could adapt other location determination systems for use in the present invention.

Field node 18 also includes receiver 41 for receiving RF signals from PTUs 20 (FIG. 1). Receiver 41 couples to processor 39 and supplies data communications originating from PTUs 20. Transmitter 42 couples to processor 39 and broadcasts RF signals conveying field report messages to control facility 12 (FIG. 1). Memory 44 and timer 46 also couple to processor 39. Memory 44 includes data serving as instructions to processor 39 and which, when executed by processor 39, cause field node 18 to carry out tasks, processes and procedures, discussed infra. Memory 44 additionally includes variables, tables and databases that are manipulated due to operation of field node 18. Processor 39 uses timer 46 to keep track of time.

Field node 18 additionally includes tamper sensor 50, audio transducer 52 and display 54, each coupled to processor 39. Tamper sensor 50 detects tampering at field node 18 and may be implemented through one or more switches or conductive circuits located in the housing (not shown) within which field node 18 resides, or may include motion sensors. Audio transducer 52 makes various audible sounds in response to control signals from processor 39. Display 54 visually displays data supplied by processor 39.

FIG. 3 is a block diagram of PTU 20 used by a preferred embodiment of the present invention. PTU 20 includes memory 58 and timer 60 coupled to processor 56. Memory 58 includes data serving as instructions to processor 56 and which, when executed by processor 56, cause PTU 20 to carry out tasks, processes and procedures discussed below. Memory 58 also includes variables, tables and databases that are manipulated due to the operation of PTU 20. Processor 56 uses timer 60 to keep track of time.

Transmitter 61 couples to processor 56 and broadcasts RF signals conveying data communications from PTU 20 to field node 18 (FIGS. 1, 2). Transmitters 42, 61 may be configured to transmit spread spectrum signals while receiver 41 may be configured to receive and decode spread spectrum signals. In observer PTUs 20'', audio transducer 62 couples to processor 56 and desirably makes audible sounds in response to control signals supplied from processor 56. Audio transducer 62 may be omitted from monitoree PTUs 20'.

Various sensors provide inputs to processor 56. For example, emergency switch 64 may be manipulated by the observer or monitoree to signal distress or emergency. Emergency switch 64 may be configured as a button, or as a lanyard which is pulled to signal an emergency. Tamper sensor 66 provides an input signaling when PTU 20 is being tampered with. For example, if PTU 20 is configured as an item of wrist apparel, tamper sensor 66 may be provided as a conductive circuit that is broken when a wrist strap is broken or unfastened and/or may include motion detectors. Body detection sensor 68 provides an input signaling when PTU 20 is no longer positioned against the body of a wearer, or may include other types of biosensors (e.g., pulse, temperature, sweat/stress monitor etc.). And, in any observer PTU 20'' (FIG. 1), horizontal sensor 70 may signal processor 56 when the wearer of PTU 20'' has been knocked down or is otherwise generally horizontal (i.e., "man down"). Sensor 70 may be a mercury switch or other device helpful in accomplishing similar functions.

FIG. 4 is a flow chart of tasks performed by observer PTUs 20'' (FIG. 1). A subset of these tasks are performed by monitoree PTUs 20'. Substantially all PTUs 20 perform the same tasks while monitorees are in field area 16. Thus, the flow chart of FIG. 4 depicts the operation of all PTUs 20.

Preferably, PTUs 20 perform tasks in a programming loop, i.e., substantially the same tasks are repetitively performed indefinitely. Query task 72 determines whether an emergency condition has been detected at PTU 20 when emergency switch 64 (FIG. 3) has been activated by the associated monitoree or observer.

Figures 5, 6:
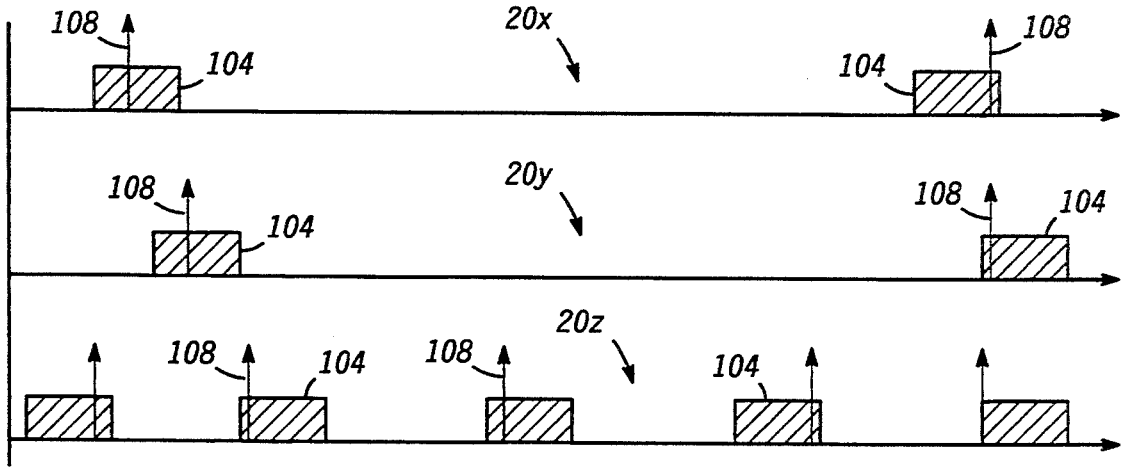
FIG. 5 is a table of variables used by the personal transmitter unit.
FIG. 6 is a timing diagram which illustrates transmission schedules for three personal transmitter units.

Furthermore, in the preferred embodiment task 72 includes a latching process (not shown) which declares an emergency condition throughout a predetermined duration, for example 30 seconds, following an initial activation of switch 64. FIG. 5 shows a table of some of the variables maintained in memory 58 that PTU 20 uses in accordance with the present invention. This latching process may utilize emergency activation timer variable 73, shown in FIG. 5. When the initial activation of switch 64 is detected, variable 73 may be set to indicate the expiration of this predetermined duration. So long as the expiration has not yet occurred, task 72 continues to declare an emergency condition regardless of whether switch 64 may still be activated. This extended emergency condition declaration increases the chances for receiving a data communication signaling the emergency condition at field node 18.

As discussed below in connection with FIG. 7, the emergency condition is treated by system 10 (FIG. 1) as a situation which requires immediate and automatic notification of control facility 12 (FIG. 1). When task 72 detects an emergency condition, program control proceeds to task 87, activating a continuous audio alarm, for example, and then to task 74. Task 74 sets short/long repeat interval mode variable 75, shown in the table of memory variables presented in FIG. 5, to indicate a short interval. As discussed below, PTU 20 repetitively transmits data communications for reception by field node 18. When emergency and other situations discussed below occur, the successful reception of such data communications by field node 18 becomes more critical than at other times. By setting a short repeat interval, a greater number of data communications are made in a given period of time, and the chances of successful communication improve.

When task 72 determines that no emergency condition is present, query task 76 determines whether an alarm condition has been detected. An alarm condition is detected when either tamper sensor 66 or body detector sensor 68 activates to indicate either tampering with PTU 20 or detachment of PTU 20 from a monitoree or observer. As discussed below in connection with FIGS. 7–9, an alarm condition is treated by system 10 (FIG. 1) as a situation which is not reported to control facility 12 unless it cannot be corrected within a predetermined period of time, for example 30 seconds to a few minutes. If the alarm condition cannot be corrected in this period of time, it is automatically reported to control facility 12. A local alarm is sounded at field node 18 so that the observer can take steps to correct the situation within this period of time. When task 76 detects an alarm condition, program control proceeds to task 80.

When task 76 determines that no alarm condition is present, task 78, which may apply only to observer PTU 20'' (FIG. 1), determines whether the observer has been knocked or has otherwise fallen down. Task 78 examines the state of horizontal sensor 70 (FIG. 3) in making its determination. If the observer is down, task 80 activates an audible alarm warning for a predetermined duration at PTU 20 by issuing appropriate commands to audio transducer 62. This audible alarm serves as a warning that a report will be sent to control facility 12 if the situation is not soon corrected. Task 80 may also set an observer down timer variable 81, shown in the table of memory variables presented in FIG. 5, the first time it is performed for an activation of sensor 70. Variable 81 may desirably be set to indicate a point in time 10–15 seconds in the future. On the other hand, if task 78 determines that the observer is not down, task 82 resets or silences any audible alarm warning which may have been activated during an earlier iteration of the programming loop. Task 82 may also set variable 81 to indicate either a point in time far into the future or a past point in time.

After task 80 or 82, query task 84 determines whether a predetermined duration has transpired since the audible alarm indicating that an observer is down was activated. This predetermined duration is the time indicated in variable 81 (FIG. 5), which was set above in task 80 during this or a previous iteration of the programming loop. If the predetermined duration has expired (block 84) and the alarm condition or observer down condition has not been corrected, a continuous audio alarm, for example, is activated in task 87, and program control proceeds to task 74. On the other hand, if the alarm has been active for less than this predetermined duration or if the alarm is not active, program control proceeds to query task 86.

PTUs 20 (FIG. 1) repetitively transmit data communications to field nodes 18 from time to time in accordance with a predetermined schedule regardless of whether an emergency, alarm, or observer down situation occurs. When an emergency, alarm, or observer down situation occurs, data communications repeat at short intervals. When no emergency, alarm, or observer down situation is detected, data communications repeat at relatively long intervals. Accordingly, query task 86 determines whether the next transmission time has occurred. Task 86 may consult next transmit time variable 88, shown in the table of memory variables presented in FIG. 5, to determine whether the current time matches or exceeds the time set in variable 88. So long as the current time is less than the time indicated by variable 88, program control loops back to task 72, discussed above.

When task 86 determines that the next transmit time has occurred, task 90 formats and transmits a data communication from transmitter 61 (FIG. 3). Task 86 preferably includes an identification (ID) code that uniquely identifies PTU 20 along with current sensor status data in the data communication. The PTU ID and sensor status data may be obtained from variables 92 and 94, respectively, shown in FIG. 5. At this point in the programming loop, the sensor status data may or may not indicate an emergency, alarm, or observer down condition.

After task 90, query task 96 determines whether a short repeat interval mode has finished. In the preferred embodiment, PTU 20 operates in its short repeat interval mode for only a little while, for example 10–30 seconds. Task 96 determines if this period of time has transpired since the short repeat interval mode was initiated. If PTU 20 has been operating in the short transmit mode and if this period of time has now transpired, task 98 resets variable 75 (FIG. 5) to indicate the long repeat interval.

When task 96 determines that PTU 20 is operating in the long repeat interval mode or when PTU 20 is operating in the short repeat interval mode and this interval has not yet finished, program control proceeds to task 100. Task 100 and following task 102 generally determine the next transmit time based upon whether PTU 20 is operating in the short or long repeat interval mode.

FIG. 6 is an exemplary timing diagram which illustrates transmission schedules for three arbitrary PTUs 20, referenced as PTUs 20*x*, 20*y*, and 20*z* for the purposes of FIG. 6. With reference to FIGS. 4 and 6, task 100 calculates when next transmit window 104 opens. Transmit window 104 represents a timing window within which PTU 20 may transmit its data communication. Transmit windows 104 for any given PTU 20 are delayed from one another in accordance with a predetermined schedule which is defined by either the short or long repeat interval modes. As shown in FIG. 6, PTUs 20*x* and 20*y* are operating in the long repeat interval mode while PTU 20*z* is operating in the short repeat interval mode. PTUs 20 operate asynchronously from one another, and windows 104 between PTUs 20 do not precisely coincide, except by rare coincidence.

For each PTU 20, task 100 calculates a next transmit window to begin a predetermined duration following the beginning of previous transmit window 104. For the long repeat interval mode, this duration may desirably be from one to ten seconds. For the short repeat interval mode, this duration may desirably be around 0.1 second. The previous transmit window 104 timing may be determined by consulting transmit window open time variable 106, shown in the table of memory variables presented in FIG. 5. Once the calculation is complete, the results may be stored back in variable 106 for use in a subsequent iteration of the programming loop.

After task 100, task 102 randomizes precise point in time 108 at which the next transmission will take place within window 104. Point in time 108 is saved in next transmit time variable 88 for use by task 86, discussed above, in future iterations of the programming loop. The chances of transmitting a data communication at any point within timing window 104 are approximately the same as the chances of broadcasting the data communication at any other point within timing window 104. And, the instant at which the data communication is broadcast within window 104 randomly changes from window 104 to window 104. Accordingly, even if PTUs 20 happen to broadcast their data communications at precisely the same time in any window 104, the chances of avoiding interference from other data communications over the course of the next few transmissions are extremely high.

In the preferred embodiment, a data communication transmission from a single PTU 20 lasts somewhere in the range of 100–200 microseconds. If, for example, as many as fifty of PTU's 20 are within range of field node 18, and each PTU 20 makes a transmission on an average of once every second, then the odds of two transmissions interfering with one another in any window 104 are less than one percent. With randomization of precise transmission times 108 within windows 104, the odds of continual interference over a few windows 104 decreases dramatically from this small percentage.

After task 102, program control loops back to task 72. Program control remains in the programming loop depicted in FIG. 4 indefinitely. Thus, PTUs 20 repetitively transmit their IDs from time to time along with their current sensor status. While FIG. 4 depicts particular tasks which are relevant to the present invention, those skilled in the art will appreciate that the PTU 20 may include additional tasks which are conventional in the art and which may be routinely included in programmable communication and processing devices.

Figure 7:
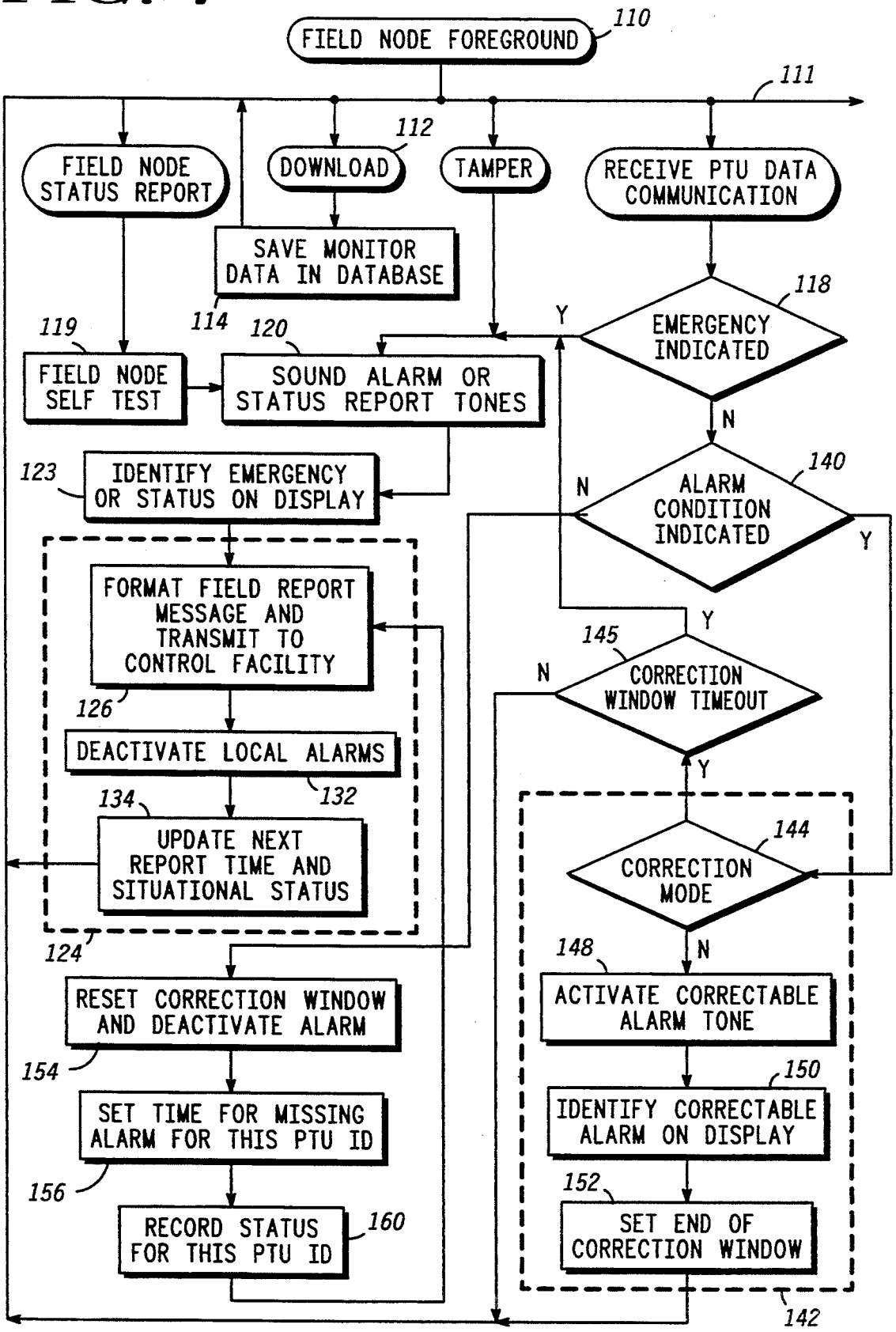
FIG. 7 is a flow chart of tasks performed by the field node in a foreground mode of operation.
Figure 8:
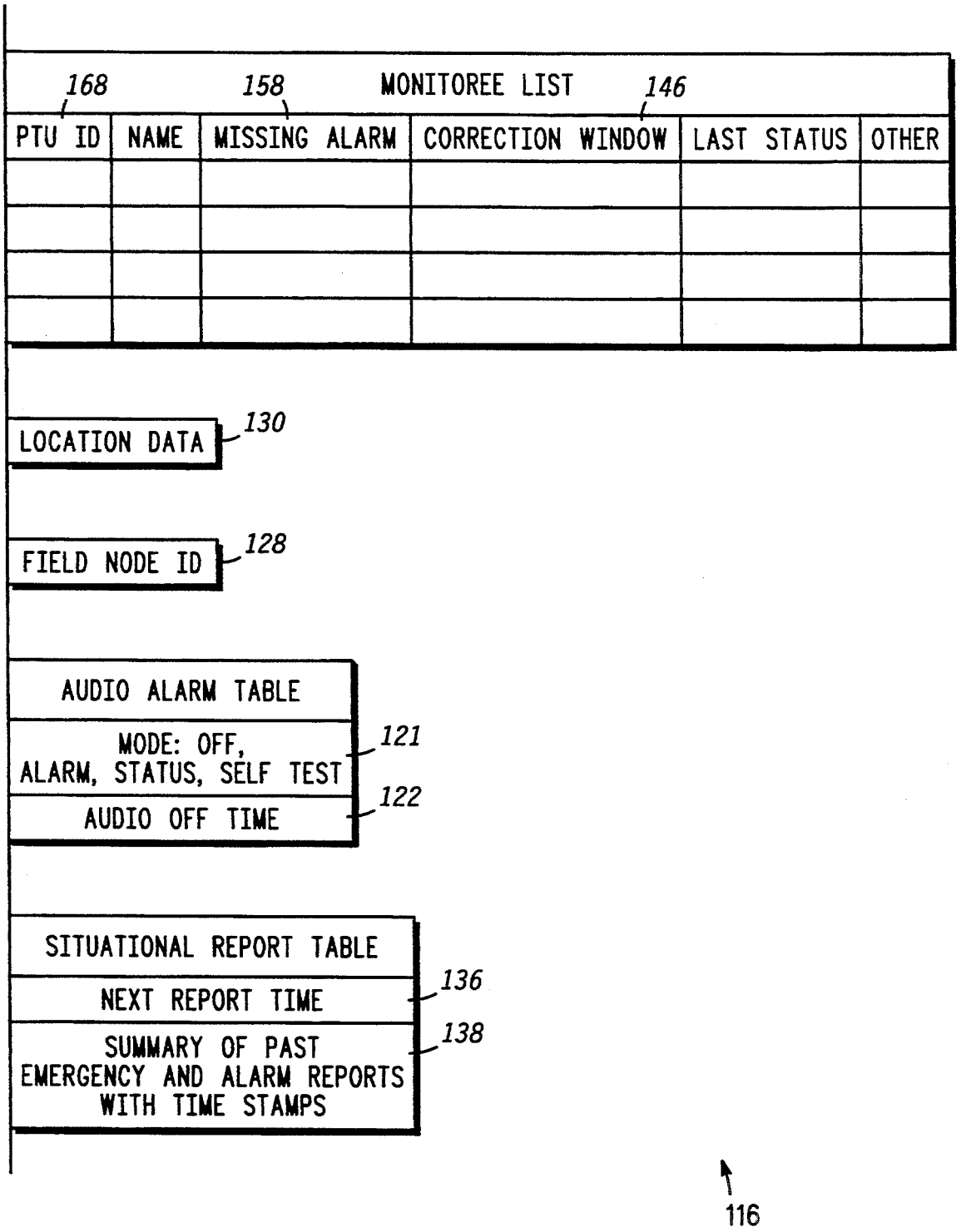
FIG. 8 is a block diagram of a database maintained in a memory of the field node.
Figure 9:
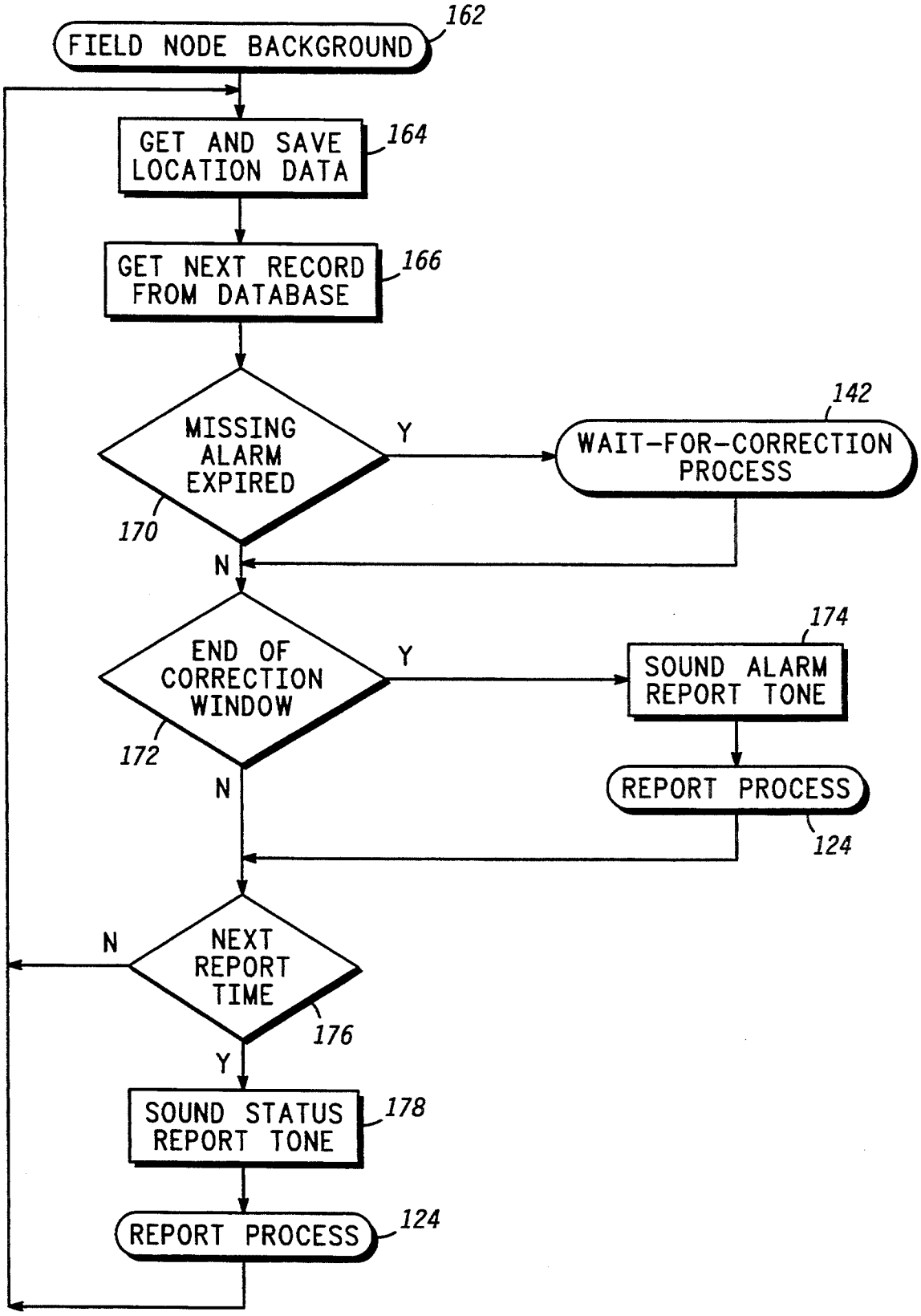
FIG. 9 is a flow chart of tasks performed by the field node in a background mode of operation.

FIGS. 7–9 depict operation of field node 18. FIG. 7 is a flow chart of tasks performed by field node 18 in procedure 110 that operates in a foreground mode. When executive node 111 of procedure 110 detects the initiation of a download operation, download process 112 is performed. A download operation occurs when data are sent to field node 18 from control facility 12 (FIG. 1). In operation, PTUs 20 and field node 18 may desirably have their unique ID codes printed thereon in the form of bar codes or the equivalent. As the observers and monitorees leave the area of control facility 12, a bar code reader or equivalent device of control facility 12 may scan or otherwise read or obtain these codes to learn which monitorees are to be associated with which observers and field nodes 18. These data along with other associated data, e.g., monitoree and observer names retained in control facility 12, nay be given to field node 18 through a download operation (block 112), wherein data are stored (block 114). The precise manner of transmitting the download data is not a critical feature of the present invention. Such data may be transmitted to field node 18 via RF communication links. Alternatively, such data may be transmitted via an RS-232 link, optical link, disk read, or other technique known to those skilled in the art.

FIG. 8 is a block diagram of database 116, into which download process 112 via task 114 saves monitor data obtained from control facility 12 (FIG. 1), in field node 18. These data, which include PTU IDs and associated monitoree and observer names as a minimum in fields 168, are retained in memory 44 (FIG. 2) of field node 18 while field node 18 is in field area 16. These data are used in monitoring PTUs 20. After task 114, program control returns to executive node 111 of procedure 110 (FIG. 7).

Executive node 111 of procedure 110 may also detect tampering with field node 18. Tampering is indicated when sensor 50 (FIG. 2) activates. When tampering is detected, program control proceeds to task 120, discussed below.

Executive node 111 of procedure 110 may also detect a field node status report request. When executive node 111 detects a field node status report request, field node self test procedure 119 is carried out and program control proceeds to task 120, discussed infra.

Executive node 111 of procedure 110 may also detect the receipt of a data communication transmitted from a PTU 20. When a data communication is detected, procedure 110 performs query task 118. Task 118 determines whether the data communication indicates an emergency condition. As discussed above, an emergency condition is indicated when emergency switch 64 of monitored PTU 20 has been activated. In addition, task 118 desirably interprets an uncorrected observer down condition, discussed above in connection with tasks 78, 80, 82, and 84 (FIG. 4), as an emergency condition. If an emergency condition is indicated, program control proceeds to task 120. As discussed above, program control also proceeds to task 120 when executive node 111 of procedure 110 detects tampering with field node 18.

Task 120 and the tasks which follow generally cause a field report message to be sent to control facility 12 to inform control facility 12 of an emergency situation or of field node status. Task 120 activates audio transducer 52 (FIG. 2) in such a manner that it sounds an alarm report tone or status report tone at field node 18. That way, the observer is informed of the emergency situation or status report and of the fact that a field report message is being sent to control facility 12. Task 120 may set mode variable 121 (FIG. 8) associated with an audio alarm table in database 116 to indicate operation in the alarm tone mode. Task 120 may also desirably set audio-off time variable 122 (FIG. 8) to indicate how long the alarm should last, and may initiate a self test.

After task 120, task 123 identifies the emergency or status on display 54 (FIG. 2). By identifying the emergency, task 123 may display the name of the monitoree or observer for whom the emergency, condition has been detected and possibly the type of emergency which is being reported to control facility 12.

After task 123, procedure 110 performs report process 124, shown within a dotted-line box in FIG. 7. Report process 124 sends the field report message to control facility 12. In particular, process 124 performs task 126 to format the field report message and to transmit the message to control facility 12.

The message constructed during task 126 desirably includes the ID of field node 18 and data describing the location of field node 18 and optionally includes status information. The ID of field node 18 may be obtained from field node ID variable 128 in database 116 (FIG. 8). The location data may be obtained either directly from location determination system 40 (FIG. 2) or indirectly from system 40 through location data variable 130 in database 116 (FIG. 8). The location data desirably varies in accordance with the operation of field node 18 to track the location of field node 18, but the ID of field node 18 desirably does not vary in accordance with the operation of field node 18.

The message constructed at task 126 also desirably includes data describing the reason for the report (i.e., emergency or status report). For example, when an emergency or alarm condition is being reported, the ID of the PTU 20 which detected the condition is reported along with data describing the nature of the condition. In addition, past reported conditions may be summarized and repeated in a current report to improve the chances of successful communication of the reports. On the other hand, when field report messages are communicated to control facility 12 over two-way communication links, successful communication of the messages may be instantly verified using well known techniques.

After task 126 sends the field report message to control facility 12, task 132 deactivates any local alarms that may have expired as indicated by variable 122 (FIG. 8). Task 132 may deactivate the alarm by setting mode variable 121 (FIG. 8) to indicate a silence or off condition, or task 132 may directly send appropriate silencing commands to audio transducer 52 (FIG. 2).

After task 132, task 134 updates a next report time and any situational status data that may be transmitted to control facility 12 in subsequent field report messages. The next report time is calculated by task 134 to occur a predetermined duration in the future. In the preferred embodiment, this time may be on the order of 5–15 minutes, but it may vary from application to application. The calculated next report time may be saved in next report time variable 136 in database 116 (FIG. 8). As discussed below, when this next report time occurs, another field report message will be sent to control facility 12 regardless of whether any emergency or alarm condition has been detected. On the other hand, nothing prevents some emergency or alarm condition from causing a field report message to be sent before the calculated next report time. Status data that may be transmitted to control facility 12 in subsequent field report messages desirably summarizes previous alarm and emergency reports. Such data may be written to area 138 of database 116 (FIG. 8) for use by subsequent iterations of task 126.

After task 134, report process 124 ends. At the end of process 124 program control returns to the procedure which invoked process 124. In the situation depicted in FIG. 7, program control returns to executive node 111 to await the next data communication from PTU 20.

Referring back to task 118, when task 118 determines that a received data communication from PTU 20 does not indicate an emergency condition, query task 140 determines whether an alarm condition is indicated. As discussed above, an alarm condition is indicated when tamper or body detection sensors 66 or 68 (FIG. 3) of PTU 20 have been activated. In addition, field node 18 may interpret missing data communications from PTU 20 as an alarm condition. However, this missing communications condition is not detected at task 140, discussed infra (FIG. 9). When an alarm condition occurs, field node 18 refrains from immediately sending a field report message to control facility 12. Rather, a local alarm is sounded at field node 18. If the alarm condition is not corrected within a predetermined period of time, hereinafter called a "correction window," field node 18 sends a field report message to control facility 12. This correction window may be on the order of a few seconds to a few minutes in duration.

When an alarm condition is indicated, procedure 110 performs wait-for-correction process 142. Generally, process 142 causes field node 18 to operate in a correction mode. In the correction mode, an alarm is sounded at field node 18 while field node 18 waits to see if an alarm condition appears to correct itself within the correction window.

The condition may appear to correct itself after human intervention. For example, an observer may issue verbal instructions to the concerned monitoree which, when performed by the monitoree, will cause the condition to correct itself. If data communications have been missed at field node 18, the observer may tell the concerned monitoree to move closer to field node 18. After the monitoree moves closer data communications will again be received at field node 18 and the condition will have appeared to correct itself. Likewise, as a result of an alarm condition an observer may tell a monitoree to move away from an interfering structure, stop activities that are interpreted as tampering or removal of the PTU 20 etc. If continued data communications indicate no alarm condition, the condition will have appeared to correct itself at field node 18. In the preferred embodiment, field node 18 is configured for safety and reliability reasons not to have switches that may be manipulated to prevent reporting of the alarm condition to control facility 12. Thus, the condition itself must be altered to prevent the alarm condition from being reported.

Process 142 performs query task 144 to determine whether field node 18 is already operating in the correction mode with respect to a particular PTU 20. Task 144 may consult database 116 in making its determination. If correction window element 146 associated with each PTU ID in database 116 indicates a time that is not possible for a current correction window, e.g., a far past or far future time, then task 144 may conclude that field node 18 is not operating in the correction mode with respect to that PTU 20. If field node 18 is already operating in the correction mode with respect to the PTU 20 from which the current data communication has been received, program control proceeds to query task 145. Query task 145 determines if the correction window has timed out. If the correction window has timed out, program control passes to task 120; otherwise, the remaining tasks in process 142 are skipped and process 142 is exited. On the other hand, when task 144 determines that field node 18 is not already operating in the correction mode with respect to the PTU 20 from which the current data communication has been received, program control performs task 148.

Task 148 activates a correctable tone at audio transducer 52 (FIG. 2) of field node 18. This tone alerts the observer to the correctable alarm condition. The observer needs to take steps to correct the alarm condition to prevent a field report message from being automatically sent to control facility 12. Task 148 may desirably set variables 121, 122 (FIG. 8) in accordance with the correctable alarm. Desirably, the correctable tone differs from the alarm tone so that the observer may easily distinguish correctable alarm conditions from alarm or emergency conditions. After task 148, task 150 identifies the correctable alarm condition on display 54. In identifying the correctable alarm condition, task 150 may display the name of the monitoree or observer for whom the correctable alarm condition has been detected and possibly the type of alarm condition which has been detected.

After task 150, task 152 sets the end of the correction window. Task 152 writes a new correction window ending value to the appropriate element 146 (FIG. 8) in database 116. This new value is desirably based on the current time and indicates a point a predetermined duration into the future. Nothing requires this predetermined duration to be the same from alarm condition to alarm condition, from monitoree to monitoree, or from observer to observer. After task 152, program control exits wait-for-correction process 142. In the situation depicted in FIG. 7, program control then returns to executive node 111 to await the next data communication received from PTU 20.

Referring back to task 140, when task 140 determines that no alarm condition is indicated, program control proceeds to task 154. At this point in procedure 110, a data communication has been received from any PTU 20, and that data communication indicates that everything appears to be in an acceptable condition for that PTU 20. In other words, no emergency or alarm conditions have been detected. This represents the normal mode of operation. Thus, task 154 resets any correction window 146 that may have been previously activated to indicate operation in a normal mode as opposed to the above-discussed correction mode. In addition, task 154 may deactivate or silence the correctable alarm tone so long as no alarms are currently active for other PTUs 20.

After task 154, task 156 sets a time value to a missing alarm element 158 (FIG. 8) in database 116. Each PTU 20 being monitored by field node 18 has a missing alarm element 158 associated with it in database 116. Task 156 sets element 158 with respect to PTU 20, from which the current data communication has been received, to indicate a point in time a predetermined duration in the future, desirably around 5–15 seconds later. If no further data communications are received from this PTU 20 by the end of the time indicated in missing alarm element 158, an alarm condition is declared by field node 18 (see FIG. 9 and associated text). On the other hand, the next time that a data communication is received from this PTU 20, the missing alarm will be reset farther into the future.

After task 156, task 160 records the status data included in the data communication in database 116, and program control then loops back to executive node 111 to await the next received data communication from a PTU 20. While FIG. 7 depicts particular tasks which are relevant to the present invention, those skilled in the art will appreciate that the foreground mode of field node 18 may include additional tasks which are conventional in the art and which may be routinely included in programmable communication and processing devices.

FIG. 9 is a flow chart of tasks performed by field node 18 in procedure 162 that operates in a background mode. Those skilled in the art will appreciate that the foreground and background modes of operation depicted for field node 18 in FIGS. 7 and 9 may be viewed as being continuously and simultaneously operational. In actual practice, however, actual processor operations may rapidly switch back and forth between these two modes at a rate which exceeds the changes in inputs that field node 18 experiences. As depicted in FIG. 9, field node background procedure 162 operates in a programming loop. In other words, substantially the same sets of tasks are performed over and over for an indefinite duration.

Among these tasks, procedure 162 performs task 164 to get and save location data. The location data are obtained from location determination system 40 (FIG. 2) and are saved in location data variable 130 in database 116 (FIG. 8). By performing task 164 over and over in the programming loop, the value contained in location data variable 130 tracks the actual location of field node 18 and field area 16 (FIG. 1).

After task 164, task 166 gets or otherwise identifies the next record for PTU ID 168 in database 116 (FIG. 8). The next record may be the one following a previously processed record. Once this record has been identified, query task 170 examines it to determine if its missing alarm element 158 (FIG. 8) indicates an expired time. As discussed above, the expiration of the missing alarm time means that no data communication has been received from the PTU 20 for a predetermined duration. This predetermined duration is set, through task 156 (FIG. 7), to be greater than the period of time required to receive several data communications in accordance with the predetermined schedule upon which the PTU 20 transmits data communications. When the alarm has expired, procedure 162 performs wait-for-correction process 142, discussed above in connection with FIG. 7. Process 142 will cause field node 18 to operate in its correction mode where an alarm will sound and a field report message will be sent to control facility 12 unless data, e.g., receipt of another data communication from the missing PTU 20, indicates correction of the situation.

After process 142 and when task 170 determines that the missing alarm has not yet expired for this PTU 20, query task 172 determines whether the current time indicates the end of a correction window for the PTU 20, assuming field node 18 is currently operating in its correction mode. Task 172 may examine correction window element 146 in database 116 (FIG. 8) for the current record's PTU 20 in making its determination. If the current time represents the end of a correction window, task 174 causes audio transducer 52 (FIG. 2) to sound the alarm report tone, and report process 124, discussed above in connection with FIG. 7, is performed. Thus, when a correctable alarm condition has been detected, but the condition is not corrected within the correction window, the alarm condition is then treated like an emergency condition. In other words, the alarm condition is immediately and automatically reported to control facility 12.

After process 124 and when task 172 determines that the end of a correction window has not occurred for the PTU record currently being processed by procedure 162, program control proceeds to query task 176. Task 176 determines whether the current time is appropriate for sending a field report message to control facility 12. Task 176 may evaluate next report time variable 136 (FIG. 8) in making its determination. Variable 136 was set by a previous performance of task 134 (FIG. 7) based upon the time at which the last field report message was sent to control facility 12. When task 176 decides that it is time to send a field report message, task 178 activates audio transducer 52 (FIG. 2) to emit a status tone, which preferably differs from the above-discussed alarm and correction tones. Next, procedure 162 performs report process 124, discussed above in connection with FIG. 7, to send a field report message to control facility 12. Process 124 additionally sets the time for sending the next field report message.

Those skilled in the art will appreciate that the performance of tasks 176 and 178 along with process 124 cause field report messages to be sent to control facility 12 from time to time even when no emergency or alarm conditions have been detected. These situational status messages simply inform control facility 12 of the current situational status at field area 16. This occasional transmission of a situational status indication to control facility 12 provides a security check which informs control facility 12 that everything in field area 16 appears to be in an acceptable condition. Such reports need not provide critical information to control facility 12. However, the absence of such reports may indicate any one of a wide variety of problems on which personnel at control facility 12 should take some action.

After process 124 and when task 176 determines that it is not yet time to send a situational status report to control facility 12, program control loops back to task 164. The programming loop will then process the next PTU record from database 116. Program control remains in the programming loop depicted in FIG. 9 indefinitely. Thus, field node 18 continually processes PTU records from database 116 while foreground procedure 110 (FIG. 7) updates the records in response to inputs from PTUs 20 and other inputs. While FIG. 9 depicts particular tasks which are relevant to the present invention, those skilled in the art will appreciate that field node 18 may include additional tasks in background procedure 162 that are conventional in the art and which may be routinely included in programmable communication and processing devices.

Figure 10:
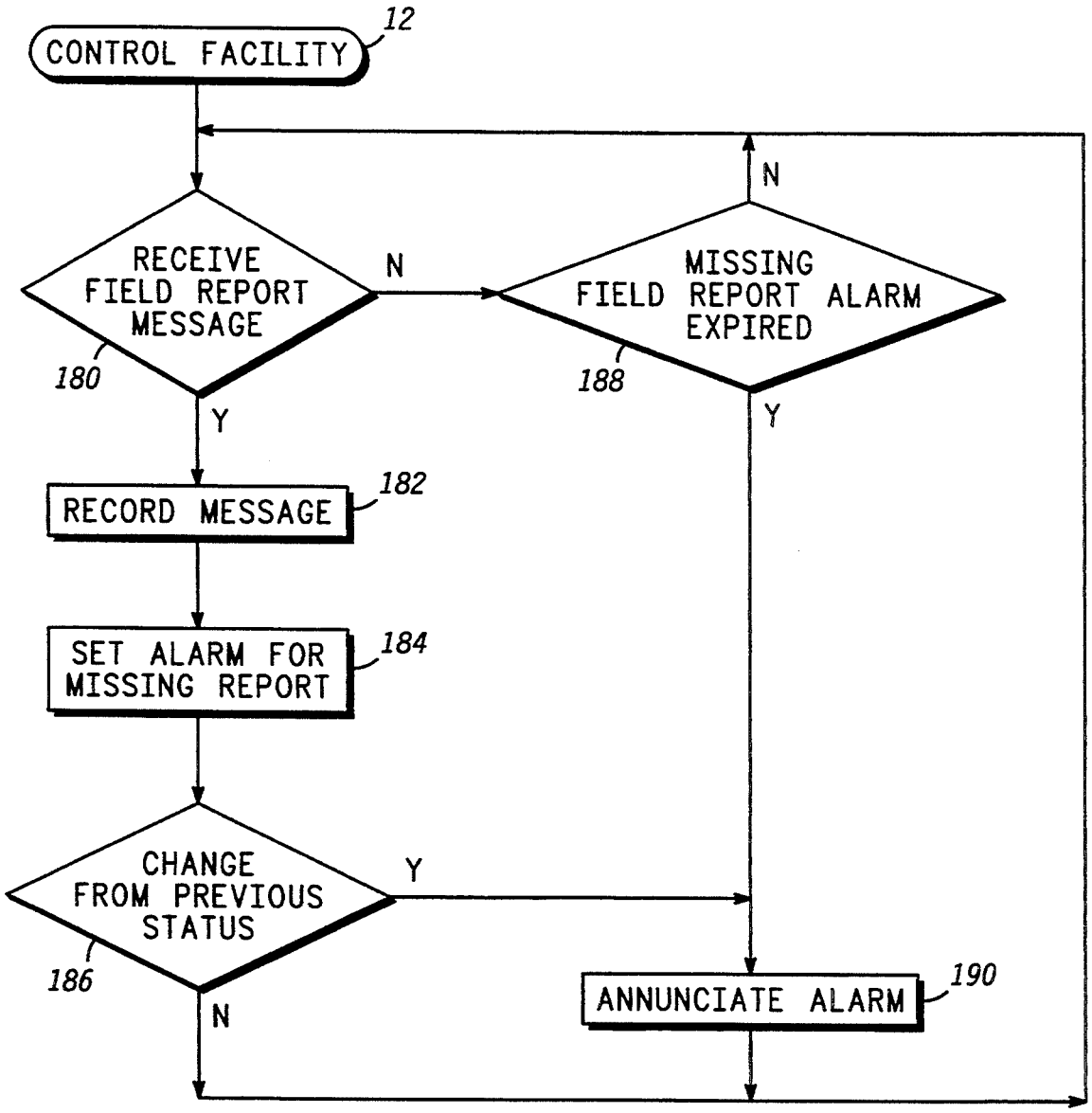
FIG. 10 is a flow chart of tasks performed by a control facility used by a preferred embodiment of the present invention.

FIG. 10 is a flow chart of tasks performed by control facility 12 (FIG. 1). Control facility 12 may perform a programming loop to track the receipt of field report messages and the possible absence of field report messages. In particular, control facility 12 may perform query task 180 to determine whether a field report message has just been received from any field node 18 in field area 16. If such a field report message has been received, then task 182 records the message, and task 184 sets a missing report alarm. This missing report alarm may operate in a manner similar to that described above in connection with element 158 (FIG. 8), except the alarm would operate for field node 18 rather than PTU 20. So long as the missing report alarm has not yet expired, no problem is indicated. However, when the missing report alarm expires, some sort of potential problem is indicated, and personnel at control facility 12 should take some action to verify and/or address the problem.

After task 184, query task 186 determines whether the field report message being processed indicates a change in status from a previous field report message for the same field node 18. In particular, task 186 determines whether the field report message identifies any new alarm or emergency condition. If no new alarm or emergency condition is indicated, program control loops back to task 180. Control facility 12 refrains from setting alarms or taking other action which would call attention to the no-change situation.

Referring back to task 180, when task 180 determines that no field report message has been received, query task 188 determines whether any field report messages are missing. In other words, task 188 determines whether the missing report alarm time discussed above in connection with task 184 has expired. If no reports are missing, program control again loops back to task 180.

On the other hand, when task 188 decides that a field report message has not been received as scheduled, program control proceeds to task 190. In addition, when task 186, discussed above, determines that a field report message indicates a change in status from a previous message received from the same field node 18, program control proceeds to task 190. Task 190 annunciates an alarm to call an operator's attention to the situation. Task 190 may, for example, print out a description of the missing report or status change situation. The operator may then examine the printout and take appropriate action, e.g., initiating a voice communication session through radios 37 and 38 (FIG. 1). After task 190 annunciates an alarm, program control again loops back to task 180.

Program control remains in the programming loop depicted in FIG. 10 indefinitely. Thus, control facility 12 continually processes received field report messages from any number of field nodes 18. This processing detects alarm and emergency conditions along with missing field report conditions. While FIG. 10 depicts particular tasks which are relevant to the present invention, those skilled in the art will appreciate that the control facility 12 may include additional tasks that are conventional in the art and which may be routinely included in programmable communication and processing devices.

In summary, the present invention provides an improved method and system for remote monitoring. The system and method of the present invention make an observer's job easier. Emergency and alarm conditions are brought to the observer's attention. Consequently, when an observer's attention is momentarily focused elsewhere, local alarms in the field area instantly cause the observer's attention to become focused on the current situation and directed to a potential problem. The present system and method reduces the costs associated with monitoring a population of monitorees. By using the present system and method, the number of monitorees that can be effectively monitored by an observer may be increased thereby reducing labor costs associated with observers. Likewise, at a control facility alarms are annunciated only when alarm or emergency conditions or missing report conditions occur. Control facility operators need not direct constant vigilance to various situations in field areas but may divert their attention to other tasks until potential problems are indicated. Furthermore, the system and method of the present invention improves safety for an observer as well as for monitorees. Instant and automatic reporting features can signal help even though a situation may render an observer incapable of initiating such signaling. The emergency signaling and quick alarming features call immediate attention to situations in which monitorees may face danger, thereby resulting in a quick response by an observer.

The present invention has been described above with reference to preferred embodiments. However, those skilled in the art will recognize that changes and modifications may be made in these preferred embodiments without departing from the scope of the present invention. Those skilled in the art will appreciate that, since computers or processors are located at the various nodes of the system of the present invention, various ones of the features discussed herein may easily be distributed differently than indicated above. For example, the location determination system may be omitted or located at the repeater node rather than the field node. Likewise, the observer down features discussed above in connection with personal transmitter units may be implemented in the field node or in the monitoree PTUs. Moreover, those skilled in the art will appreciate that additional items of status data may be communicated and processed through the system of the present invention. For example, battery status and results of self tests may be desirable for inclusion with the status items discussed above. These and other changes and modifications which are obvious to those skilled in the art are intended to be included within the scope of the present invention.

What is claimed is:

1. A method of monitoring a plurality of monitorees, said method comprising steps of:

retaining, at a field node, wherein said monitorees and said field node are remotely located relative to a control facility, data identifying unique codes for said monitorees;

associating a transmitter with each of said monitorees;

from each of said transmitters, repetitively transmitting one of said unique codes from time to time in accordance with a predetermined schedule;

receiving at least a portion of said transmitted codes at said field node;

activating an alarm at said field node when one of said unique codes has not been received in accordance with said predetermined schedule, sending a field report message from said field node to said control facility after said activation step; and refraining from sending said field report message until a predetermined duration has transpired after said activation step.

2. A method as claimed in claim 1 additionally comprising a step of deactivating said alarm when said one of said unique codes is subsequently received.

3. A method as claimed in claim 1 wherein said activating step comprises a step of sounding an audio alarm.

4. A method as claimed in claim 1 wherein said activating step comprises a step of displaying, at said field node, data identifying a particular monitoree associated with said one of said unique codes.

5. A method as claimed in claim 1 wherein said repetitively transmitting step comprises a step of randomizing points in time at which said unique codes are transmitted from said transmitters.

6. A method as claimed in claim 1 wherein said method additionally comprises a step of sending field report messages from said field node to said control facility from time to time when all of said unique codes are being received in accordance with said schedule, said field report messages keeping said control facility informed of current situational status at said area.

7. A method as claimed in claim 1 wherein said method additionally comprises steps of:

determining a location for said area; and sending field report messages from said field node to said control facility from time to time, said field report messages including data describing said location.

8. A method as claimed in claim 1 wherein said method additionally comprises steps of:

transmitting field report messages from said field node from time to time;

receiving said field report messages all a repeater node; and transmitting said field report messages from said repeater node to said control facility.

9. A method as claimed in claim 1 wherein said method additionally comprises steps of:

detecting tampering with said field node; and sending a field report message from said field node to said control facility when said tampering is detected to inform said control facility of said tampering.

10. A method as claimed in claim 1 wherein said method additionally comprises steps of:

sending field report messages from said field node to said control facility from time to time, said field report messages describing current situational status at said area; and annunciating an alarm at said control facility if said current situational status indicates a change from a previous status.

11. A method as claimed in claim 1 wherein:

each of said transmitters is included in a detection unit; and said transmitting step includes a step of transmitting status data with said unique code, said status data indicating whether an alarm condition has been detected at said detection unit; and said method additionally comprises steps of:

receiving said status data in association with said unique codes at said field node; and initiating said alarm at said field node in response to reception of status data indicating said alarm condition.

12. A method as claimed in claim 11 wherein:

said status data indicating said alarm condition are associated with a particular detection unit; and said method additionally comprises a step of sending a field report message from said field node to said control facility after a predetermined duration has transpired following said initiating step, said field report message informing said control facility of said alarm condition, unless status data received from said particular detection unit within said predetermined duration indicate no alarm condition.

13. A method as claimed in claim 1 wherein:

each of said transmitters is included in a detection unit;

said transmitting step transmits status data with said unique code for each detection unit, said status data indicating whether an emergency condition has been detected at said detection unit; and said method additionally comprises steps of:

receiving said status data at said field node; and sending a field report message from said field node to said control facility in response to reception of status data indicating said emergency condition to inform said control facility of said emergency condition.

14. A method of monitoring a plurality of monitorees in an area remote to a control facility, said method comprising steps of:

retaining, at a field node in said remote area, data identifying unique codes for said monitorees;

associating a detection unit with each of said monitorees;

from each of said detection units, repetitively transmitting one of said unique codes from time to time in accordance with a predetermined schedule;

receiving at least a portion of said transmitted codes at said field node;

activating an alarm at said field node when one of said unique codes has not been received in accordance with said schedule; and sending a field report message from said field node to said control facility after a predetermined duration has transpired following said activating step unless said one unique code is received within said predetermined duration.

15. A method as claimed in claim 14 additionally comprising a step of sending field report messages from said field node to said control facility from time to time when all said unique codes are received in accordance with said schedule to keep said control facility informed of current situational status at said area.

16. A method as claimed in claim 14 additionally comprising steps of:

detecting tampering with said field node; and sending a field report message from said field node to said control facility when said tampering is detected to inform said control facility of said tampering.

17. A method as claimed in claim 14 wherein said transmitting step includes a step of transmitting status data with said unique code, said status data indicating whether an alarm condition has been detected at said detection unit, said method additionally comprising steps of:

receiving said status data in association with said unique codes at said field node; and initiating said alarm at said field node in response to reception of status data indicating said alarm condition.

18. A method as claimed in claim 17 wherein:

said status data indicating said alarm condition are associated with a particular detection unit; and said method additionally comprises a step of sending a field report message from said field node to said control facility after a predetermined duration has transpired following said initiating step, said field report message informing said control facility of said alarm condition, unless status data received from said particular detection unit within said predetermined duration indicate no alarm condition.

19. A method as claimed in claim 14 wherein said transmitting step includes a step of transmitting status data with said unique code for each detection unit, said status data indicating whether an emergency condition has been detected at said detection unit, said method additionally comprising steps of:

receiving said status data at said field node; and sending a field report message from said field node to said control facility in response to reception of status data indicating said emergency condition in order to inform said control facility of said emergency condition.

20. In a system for monitoring a plurality of monitorees in which a detection unit is associated with each monitoree, each detection unit has a unique code associated therewith, and each detection unit is configured to repetitively transmit its unique code from time to time in accordance with a predetermined schedule, a field node, wherein said monitorees and said field node are remotely located relative to a control facility, said field node comprising:

a receiver for receiving said unique codes transmitted from said detection units;

processing means, coupled to said receiver, for obtaining at least a portion of said unique codes transmitted from said detection units;

a memory, coupled to said processor means, for retaining programming instructions defining how said processing means manages operation of said field node and for retaining data identifying said unique codes;

alarm means, coupled to said processing means, for indicating when one of said unique codes has not been received in accordance with said schedule; and a transmitter coupled to said processing means, said transmitter for sending a field report message from said field node to said control facility after a predetermined duration has transpired following activation of said alarm means.

21. In a system for monitoring a plurality of monitorees, a field node as claimed in claim 20 wherein said alarm means comprises:

an audio transducer, coupled to said processing means, for audibly indicating an alarm; and display means, coupled to said processing means, for visually identifying a monitoree for whom an alarm has been activated.

22. In a system for monitoring a plurality of monitorees, a field node as claimed in claim 20 wherein said field node is configured to refrain from sending said field report message until said predetermined duration has transpired.

23. In a system for monitoring a plurality of monitorees, a field node as claimed in claim 20 wherein said transmitter is configured to send field report messages from said field node to said control facility from time to time when all said unique codes are being received in accordance with said schedule to keep said control facility informed of current situational status at said area.

24. In a system for monitoring a plurality of monitorees, a field node as claimed in claim 20 wherein said monitorees and said field node are located in an area remote to a control facility, and said field node additionally comprises:

location determination means coupled to said processing means; and a transmitter, coupled to said processing means, for sending field report messages from said field node to said control facility from time to time, said messages including data describing said location.

25. In a system for monitoring a plurality of monitorees, a field node as claimed in claim 20 wherein said monitorees and said field node are remotely located relative to a control facility, and said field node additionally comprises:

means, coupled to said processing means, for detecting tampering with said field node; and a transmitter, coupled to said processing means, said transmitter for sending a field report message from said field node to said control facility to inform said control facility of tampering detected by said detecting means.

26. In a system for monitoring a plurality of monitorees wherein each of said detection units transmits status data with its unique code, said status data indicating whether an alarm condition has been detected at said detection unit, a field node as claimed in claim 20 additionally configured to obtain said status data in association with said unique codes and to activate said alarm means in response to reception of status data which indicate said alarm condition.

* * * * *